US006335057B1

(12) United States Patent
Noura et al.

(10) Patent No.: US 6,335,057 B1
(45) Date of Patent: Jan. 1, 2002

(54) METALLIC MULTILAYER COATING FILMS FORMATION PROCESS

(75) Inventors: Kohsuke Noura; Hideo Sugai, both of Hiratsuka; Yasumasa Okumura, Yokohama, all of (JP)

(73) Assignee: Kansai Paint Co., Ltd., Hyogo (JP)

( * ) Notice: Subject to any disclaimer, the term of this patent is extended or adjusted under 35 U.S.C. 154(b) by 0 days.

(21) Appl. No.: 09/463,492

(22) PCT Filed: Jul. 22, 1998

(86) PCT No.: PCT/JP98/03264

§ 371 Date: Jan. 27, 2000

§ 102(e) Date: Jan. 27, 2000

(87) PCT Pub. No.: WO99/04910

PCT Pub. Date: Feb. 4, 1999

(30) Foreign Application Priority Data

| | | |
|---|---|---|
| Jul. 25, 1997 | (JP) | 9-213923 |
| Oct. 29, 1997 | (JP) | 9-311561 |
| Jan. 6, 1998 | (JP) | 10-000593 |

(51) Int. Cl.[7] ..... B05D 1/36; B05D 1/38; B05D 5/06

(52) U.S. Cl. ..... 427/380; 427/381

(58) Field of Search ..... 427/407.1, 380

(56) References Cited

U.S. PATENT DOCUMENTS

| | | | | |
|---|---|---|---|---|
| 4,835,018 A | | 5/1989 | Higginbotham et al. | 427/380 |
| 4,869,754 A | * | 9/1989 | Kawabe et al. | 106/404 |

FOREIGN PATENT DOCUMENTS

| | | |
|---|---|---|
| JP | 3-68478 | 3/1991 |
| JP | 3-504870 | 10/1991 |
| JP | 5-200358 | 8/1993 |
| JP | 5-228421 | 9/1993 |
| JP | 5-309996 | 11/1993 |
| JP | 8-309280 | 11/1996 |
| JP | 9-1050 | 1/1997 |
| JP | 9-168765 | 6/1997 |

* cited by examiner

*Primary Examiner*—Erma Cameron
(74) *Attorney, Agent, or Firm*—Wenderoth, Lind & Ponack, L.L.P.

(57) ABSTRACT

There is disclosed a process to form metallic multilayer coating films characterized by coating on the uncured coating surface of a paint formed on a substrate with a composition (B), which contains non-leafing aluminum flake and organic solvent and then by coating, optionally after coating with a topcoat paint (C), with a clear paint (D). According to said process metallic multilayer coating films, which is white, excellent in metallic luster impression and having a high flip-flop effect, can be formed by using non-leafing aluminum flake pigment.

17 Claims, No Drawings

METALLIC MULTILAYER COATING FILMS FORMATION PROCESS

TECHNICAL FIELD

The present invention relates to a novel process to form metallic multilayer coating films by using a non-leafing aluminum flake pigment.

BACKGROUND ART

It is already known to form metallic coating films by coating a metallic paint containing aluminum flake and then coating a clear paint and the process is being widely used for top coating of automobile outer panels etc. This metallic coating film has a glittering brilliance and is excellent in design ability. Said metallic coating film, however, consists mainly of resin component, non-leafing aluminum flake and color pigment, and aluminum flake often orientates irregularly in fact, contrary to an ideal orientation within the coating film which is uniform and parallel to the coating surface, and, therefore, it is difficult to form a metallic coating film, which is white, excellent in metallic luster impression and has a high flip-flop effect, which aluminum flake intrinsically possesses.

The purpose of the present invention is to provide a novel process to form a metallic coating film, which is white, excellent in metallic luster impression and has a high flip-flop effect, which aluminum flake intrinsically possesses by orientating the flake parallel to the coating surface, when forming a metallic coating film by using a non-leafing aluminum flake pigment.

This time it was found that the above-mentioned purpose could be achieved by using a coating composition which contains non-leafing aluminum flake and organic solvent but not substantially contains a resin component or contains low amount of it, even if it is contained.

DISCLOSURE OF THE INVENTION

Thus, according to the present invention it is provided a process to form metallic multilayer coating films characterized by coating on the uncured coating surface of a paint formed on a substrate with a composition (B), which contains non-leafing aluminum flake and organic solvent and less than 300 parts by weight (as solid content) of resin component per 100 parts by weight of non-leafing aluminum flake, and by coating, optionally after coating with a topcoat paint (C), with a clear paint (D) (hereinafter referred to as the process of the present invention).

Then the process of the present invention is described in more detail.

BEST MODE FOR CARRYING OUT THE INVENTION

Substrate

The substrate on which metallic multilayer coating films can be formed according to the process of the present invention is not particularly limited and there can be mentioned, for example, outer panels of bodies of motorcars such as passenger car, truck, motorcycle, bus etc. or outer panels of electric appliances, made of metal or plastics. Among them, metallic substrate is preferably chemically treated previously with phosphates, chromates etc. Moreover, such a substrates is preferably coated previously with an undercoat paint such as cationic electrodeposition paint and optionally further coated with an intermediate paint. As undercoat paint and intermediate paint there is no particular limitation and various kinds of per se known paints can be used.

Uncured Coating Surface

In the process of the present invention an uncured coating surface of a paint is formed first on a substrate. The basecoat paint used to form the uncured coating surface may be a substantially non-crosslinking, organic solvent type paint dryable at normal temperature. Generally, however, an organic solvent type thermocurable basecoat paint (A) is preferable.

The organic solvent type thermocurable basecoat paint (A) consists fundamentally of base resin, crosslinking agent and organic solvent. As a base resin there can be mentioned, for example, resins such as polyester resin, alkyd resin, acrylic resin, vinyl resin etc. having crosslinking functional group such as hydroxyl group etc. As a crosslinking agent there can be mentioned, for example, melamine resin, polyisocyanate compounds which may be blocked, etc., which crosslink with such a functional group. Further, as an organic solvent usual solvents for paint use such as hydrocarbons, esters, ethers, alcohols, ketones etc. can be used. The compounding ratio of base resin and crosslinking agent in the basecoat paint (A) is suitable in the range of 50–90%, particularly 60–80%, of base resin and 50–10%, particularly 40–20%, of crosslinking agent based upon the total weight of solid content of both components.

It is preferable to compound a resin composition containing phosphoric acid group in the basecoat paint (A) in order to improve the adhesivity with the coating film formed by coating of the composition (B) to be described later.

As a resin composition containing phosphoric acid group there can be mentioned, for example, substances shown below.

(P-1) A polymer containing in the molecule phosphoric acid group and hydroxyl group which contains an unsaturated monomer unit containing phosphoric acid group and an unsaturated monomer unit containing hydroxyl group as constitutional components.

(P-2) A non-aqueous dispersion containing phosphoric acid group consisting of dispersed polymer particles, which are polymer particles containing an unsaturated monomer unit containing phosphoric acid group as a constitutional component, in a solution of a high molecular dispersion stabilizer in an organic solvent.

The unsaturated monomer containing phosphoric acid group used in the preparation of the polymer (P-1) is a compound containing at least each one of a polymerizable unsaturated bond and a phosphoric acid group represented by the following formula (I) in the molecule.

$$—OPO(OH)(R_1) \quad (I)$$

wherein $R_1$ is hydroxyl group, phenyl group or alkyl group of carbon number 1–20.

As such unsaturated monomer containing phosphoric acid group there can be mentioned, for example, (meth) acryloyloxy-$C_{2-20}$-alkyl acid phosphates such as (2-acryloyloxyethyl) acid phosphate, (2-methacryloyloxyethyl) acid phosphate, (2-acryloyloxypropyl) acid phosphate, (2-methacryloyloxypropyl) acid phosphate, 10-acryloyloxydecyl acid phosphate, 10-methacryloyloxydecyl acid phosphate etc. Furthermore an equimolar adduct of glycidyl (meth)acrylate and mono-$C_{1-20}$alkylphosphoric acid can be used as an unsaturated monomer containing phosphoric acid group.

An unsaturated monomer containing hydroxyl group used in the preparation of the polymer (P-1) is a compound having hydroxyl group and polymerizable unsaturated bond in the molecule and there can be mentioned, for example, monoesters of a $C_{2-20}$-alkylene glycol and (meth)acrylic acid such as hydroxyethyl (meth)acrylate, hydroxypropyl (meth)acrylate, hydroxybutyl (meth)acrylate etc.

The polymer (P-1) can be prepared by copolymerizing the above-mentioned unsaturated monomer containing phosphoric acid group and unsaturated monomer containing hydroxyl group as essential components and, as necessary, other monomer and/or monomer containing N-alkoxymethylamide group etc.

The other monomers used in the preparation of the polymer (P-1) as necessary are other polymerizable unsaturated compounds than the above-mentioned unsaturated monomer containing phosphoric acid group, unsaturated monomer containing hydroxyl group and the monomer containing N-alkoxymethylamide group mentioned below and there can be mentioned, for example, a monoesterified compound of (meth)acrylic acid and a monohydric alcohol of carbon number 1–22, an olefin, styrene, acrylonitrile, vinyl acetate, vinyl chloride, (meth)acrylic acid, maleic acid, maleic anhydride etc.

The above-mentioned monomer containing N-alkoxymethylamide group is a compound having N-alkoxymethylamide group and polymerizable unsaturated bond in the molecule and there can be mentioned, for example, N-methoxymethyl (meth)acrylamide, N-ethoxymethyl (meth)acrylamide, N-butoxymethyl (meth) acrylamide, N-propoxymethyl (meth)acrylamide etc.

The polymer (P-1) can be prepared by copolymerizing the above-mentioned monomers according to per se known processes, for example, solution polymerization. The application ratio of the monomer containing phosphoric acid group and the monomer containing hydroxyl group in that case is preferable in the range of 10–90%, particularly 20–80% and more particularly 50–70% of the former and 90–10%, particularly 80–20% and more particularly 50–30% of the latter based upon the total weight of said both monomers. The application amount of other monomers is suitable in the range of less than 1000 parts by weight, particularly 10–500 parts by weight and more particularly 50–150 parts by weight and the application amount of the monomer containing N-alkoxymethylamide group is suitable in the range of less than 500 parts by weight, particularly 10–300 parts by weight per 100 parts by weight of the total of said both monomers.

The polymer (P-1) preferably has a hydroxyl group value in the range of 5–150 mgKOH/g, particularly 10–100 mgKOH/g, an acid value based upon the phosphoric acid group in the range of 10–150 mgKOH/g, particularly 20–130 mgKOH/g, and a number-average molecular weight in the range of 1,000–100,000, particularly 3,000–50,000. The polymer (P-1) can be made self-crosslinkable by using a monomer containing N-alkoxymethylamide group together.

The polymer particles in the dispersion (P-2) can be prepared by polymerizing an unsaturated monomer containing phosphoric acid group, together with other monomers as necessary.

As the unsaturated monomer containing phosphoric acid group, a constitutional component of the polymer particles, there can be used, for example, a compound containing both phosphoric acid group and polymerizable unsaturated bond represented by the formula (I) which was described in the polymer (P-1).

A compound represented by the following formula (II) can be used also as an unsaturated monomer containing phosphoric acid group.

$$CH_2 \mathbf{32}\ CX—CO—(YO)_n—OPO(OH)_2 \quad (II)$$

wherein X is hydrogen atom or methyl group, Y is alkylene group of the carbon number 2–4 and n is an integer of 3–30.

As specific example of the compound represented by the above-mentioned formula (II) there can be mentioned, for example, acid phosphoxyhexa(or dodeca)(oxypropylene) monomethacrylate etc.

As another monomer copolymerizable with a polymerizable unsaturated monomer containing phosphoric acid group there can be used a compound having at least one polymerizable unsaturated bond in the molecule and there can be specifically mentioned, for example, $C_{1-18}$alkyl esters of (meth)acrylic acid; glycidyl (meth)acrylate; $C_{2-8}$alkenyl esters of (meth)acrylic acid; $C_{2-8}$hydroxyalkyl esters of (meth)acrylic acid; $C_{3-18}$alkenyloxyalkyl esters of (meth) acrylic acid; esters of $C_{2-8}$hydroxyalkyl esters of (meth) acrylic acid and caprolactone; diesters of glycol and (meth) acrylic acid; vinyl aromatic compounds; α,β-ethylenic unsaturated acids; (meth)acylamides; (meth)acrylonitrile, vinyl propionate, isocyanatoethyl (meth)acrylate, perfluorocyclohexyl (meth)acrylate, N-methyl-p-styrenesulfonamide, γ-methacryloxypropyl trimethoxysilane etc.

The application ratio of the polymerizable unsaturated monomer containing phosphoric acid group and another copolymerizable monomer to prepare the polymer particles in the non-aqueous dispersion (P-2) is preferable in the range of 0.1–100% by weight, particularly 0.5–50% by weight and particularly 3–30% by weight of the former and 99.9–0% by weight, particularly 99.5–50% by weight and particularly 97–70% by weight of the latter based upon the total of both monomers.

The non-aqueous dispersion (P-2) can be prepared by polymerizing the above-mentioned monomer components in a solution of polymer dispersion stabilizer in an organic solvent into a particle shape and, as a result, a non-aqueous dispersion consisting of polymer particles derived from the monomer components dispersed in a solution of polymer dispersion stabilizer in an organic solvent is obtained.

A polymer dispersion stabilizer is a substance for stably dispersing the polymer particles and there is used a substance which is compatible with the organic solvent in said dispersion but almost incompatible with coexisting polymer particles whose constitutional component is a polymerizable unsaturated monomer unit containing phosphoric acid group.

As such a polymer dispersion stabilizer there can be mentioned 1) a polyester macromonomer (1a) prepared by introducing polymerizable unsaturated bond through addition of glycidyl (meth)acrylate to self-condensing polyester resin of fatty acid containing hydroxyl group such as 12-hydroxystearic acid, and a polymer (1b) prepared by polymerizing polymerizable monomer to this macromonomer (1a); 2) a polymer prepared by first polymerizing monomer containing glycidyl (meth)acrylate to the above-mentioned macromonomer (1a) and then introducing polymerizable unsaturated bond through addition of ethylenic unsaturated acid to the glycidyl group in this polymer; 3) an acrylic resin containing hydroxyl group; 4) an acrylic resin containing hydroxyl group in which polymerizable unsaturated bond is introduced; 5) alkyletherified melamine resin with a high mineral spirit permissibility; 6) an oil-modified alkyd resin and an oil-modified alkyd resin in which polymerizable unsaturated bond is introduced; 7) cellulose acetate butyrate having polymerizable unsaturated bond, etc.

Such a dispersion stabilizer has preferably weight-average molecular weight in the range of generally about 1,000–about 50,000, particularly about 3,000–about 20,000.

Among these dispersion stabilizers acrylic resin type ones mentioned in the above-mentioned 3), 4) etc., which are easily soluble in low polar organic solvent such as aliphatic hydrocarbons and have good weatherability etc., are particularly preferable.

Organic solvents used for the preparation of the non-aqueous dispersion (P-2) are those which dissolve the polymer dispersion stabilizer and can disperse polymer particles without substantially dissolving them and there can be mentioned, for example, solvents such as hydrocarbon type solvents, ester type solvents, ketone type solvents, alcohol type solvents, ehter type etc. with a boiling point of lower than about 150° C.

The non-aqueous dispersion (P-2) can be prepared by first dissolving the above-mentioned polymer dispersion stabilizer in an organic solvent and then dispersion polymerizing the monomer component containing polymerizable unsaturated monomer containing phosphoric acid group. In the non-aqueous dispersion (P-2) the average particle diameter of the polymer particles derived from the monomer component containing polymerizable unsaturated monomer containing phosphoric acid group lies preferably in the range of usually 0.01–1 $\mu$m.

The dispersion polymerization in the solution of the polymer dispersion stabilizer in an organic solvent can be performed by known polymerization process such as radical polymerization etc. The constitutional ratio of each component, for example, the ratio of polymer dispersion stabilizer and monomer component is suitably in the range of 0.1–70%, particularly 5–50% of polymer dispersion stabilizer and 99.9–30%, particularly 95–50% of monomer component based upon the total solid content weight of both said components. Moreover, the ratio of said total solid content of polymer dispersion stabilizer and monomer component and the organic solvent is suitably in the range of 5–60%, particularly 20–50% of the former and 95–40%, particularly 80–50% of the latter.

In case a cross-linking functional group such as hydroxyl group exists in the molecule of polymer dispersion stabilizer and/or polymer particles, a 3-dimensionally crosslinked coating film can be formed by compounding a crosslinking agent in the non-aqueous dispersion (P-2).

In the monomer component to prepare the polymer particles, said polymer particles can be made intraparticle crosslinkable by using a monomer having more than two polymerizable unsaturated bonds in the molecule together with the polymerizable unsaturated monomer containing phosphoric acid group, or by using a monomer having self-crosslinking reactive group such as N-alkoxymethylated acrylamide.

The basecoat paint (A) preferably used to form the "uncured coating surface" consists of, as mentioned above, base resin, crosslinking agent and organic solvent and, preferably compounded with a resin composition containing phosphoric acid group. The compounding amount of the resin composition containing phosphoric acid group (as solid content) is suitably in the range of less than 70 parts by weight, particularly 0–50 parts by weight, more particularly 5–25 parts by weight per 100 parts by weight of the total solid content of base resin and crosslinking agent.

To the basecoat paint (A) there can be suitably compounded, besides the above-mentioned components, as necessary, color pigment, glittering pigment (metallic pigment), extender pigment, curing catalyst, levelling agent, antioxidant, flow adjustment agent, pigment dispersing agent, silane coupling agent etc.

The basecoat paint (A) can be preferably coated on the above-mentioned coating surface to the film thickness as a cured coating film of about 5–about 35 $\mu$m, particularly about 5–about 25 $\mu$m by means of electrostatic coating, airless spray, air spray etc.

The "uncured coating surface" in the process of the present invention can be preferably the uncured coating surface of the above-mentioned basecoat paint (A) and specifically the coating film obtained by coating the basecoat paint (A) and leaving the coating film as it is at room temperature for several minutes or more. Furthermore, the coating surface obtained by forcedly drying said coating film at 50–100° C. for some 1–30 minutes (gel ratio is less than 60% by weight, particularly less than 40% by weight) is also included in the "uncured coating surface". The gel ratio is a value calculated, after extracting the coating film, peeled off after forced drying from the tin plate on which a composition consisting of only the base resin, crosslinking agent and organic solvent used in the basecoat paint (A) is coated, in a net-shaped vessel made of stainless steel of 300 mesh for 6 hours by using acetone/methanol=1/1 solvent, according to the following formula.

Gel ratio (%)=(weight of sample after extraction/weight of sample before extraction)×100

Composition (B)

The composition (B) used in the process of the present invention is to give a metallic feeling to the final multilayer coating films and is characterized by the point that it contains non-leafing aluminum flake and organic solvent and does not substantially contain resin component or contains only much lower amount of it, even if it is contained, compared with a usual metallic paint. When such a composition (B) is coated on the above-mentioned uncured coating surface, non-leafing aluminum flake orientates in the coating film in parallel to the coating surface and uniformly and thus a metallic coating film, which is white, excellent in metallic luster impression with a high flip-flop effect, can be obtained.

Non-leafing aluminum flake used for the composition (B) is a metallic pigment which is a flake-like aluminum and has a property of not floating to the surface within a coating film with fluidity but of dispersing inside the coating film. This can be obtained, for example, by mechanically crushing metallic aluminum into flake-like by stamp mill process, dry ball mil process, wet ball mill etc. during which the surface of the flake is covered by an anti-friction agent (lubricant) such as oleic acid to make non-leafing type. Besides, crushed aluminum can be made non-leafing type by treating with salts of metals such as lead, zinc etc. or a polar solvent. The size of this non-leafing aluminum flake is generally preferable to be about 2–about 50 $\mu$m in longitudinal length and about 0.1–about 2 $\mu$m in thickness.

Organic solvent used for the composition (B) is not so particularly restricted so long as it is a solvent for paint use and there can be mentioned, for example, hydrocarbon type solvent, ester type solvent, ketone type solvent, alcohol type solvent, ether type solvent etc.

The compounding ratio of non-leafing aluminum flake and organic solvent in the composition (B) is preferably in the range of, for example, 1–50% by weight, particularly 1.5–30% by weight, more particularly 2–7% by weight of the former and 99–50% by weight, particularly 98.5–70% by weight, more particularly 98–93% by weight of the latter, based upon the total amount of both these components.

The composition (B) can be prepared by mixing and dispersing non-leafing aluminum flake in organic solvent. The composition (B) can consist substantially of non-leafing aluminum flake and organic solvent only but it is possible to suitably compound, as necessary, resin for paint use, resin composition containing phosphoric acid group (P-1), resin composition containing phosphoric acid group (P-2), anti-settling agent, electrostatic auxiliary etc.

Among these, as resin for paint use there can be mentioned compositions consisting of base resin, having crosslinking functional group such as hydroxyl group, such as polyester resin, alkyd resin, acrylic resin, vinyl resin etc., and crosslinking agent such as melamine resin, polyisocyanate compound which may be blocked, etc.

The compounding amount (as solid content) of resin component such as resin for paint use, resin composition containing phosphoric acid group (P-1) or resin composition containing phosphoric acid group (P-2) should be less than 300 parts by weight per 100 parts by weight of non-leafing aluminum flake, respectively, and is suitable in the range of preferably 0.1–200 parts by weight, more preferably 1–100 parts by weight. Particularly, compounding of a small amount of resin composition containing phosphoric acid group (P-1) or (P-2) among them is preferable, because destruction of the coating film of the composition (B) due to aggregation of aluminum flake can be prevented and the interlayer adhesivity with the neighboring coating films can be improved at the same time.

As antisettling agent there can be mentioned, for example, fatty acid amide wax, polyethylene oxide etc. Its compounding amount as solid content is suitably in the range of less than 50 parts by weight, preferably 1–30 parts by weight, more preferably 5–20 parts by weight per 100 parts by weight of non-leafing aluminum flake.

According to the process of the present invention the composition (B) can be coated on the above-mentioned "uncured coating surface" by means of electrostatic coating, airless spray, air spray etc. Its coating film thickness as cured coating film (containing non-leafing aluminum flake only, or occasionally other solid content) is suitably in the range of about 0.5–about 5 $\mu$m, particularly about 0.8–about 2 $\mu$m.

When the composition (B) containing aluminum flake and organic solvent and containing no resin component or with very little content of it, even if it is contained, is coated on the "uncured coating surface", the solvent either penetrates to the coating surface of the underlayer or evaporates, bringing the concentration of aluminium flake in the coating film of the composition (B) higher and the aluminium flake tends to be easier orientated uniformly and densely in the parallel (horizontal) direction on the uncured coating surface. As a result, a metallic coating film, which is white, excellent in metallic luster impression with a high flip-flop effect which has not been seen in the metallic coating film by using a conventional paint containing non-leafing aluminium flake, can be formed.

In the process of the present invention, after the composition (B) is coated on the "uncured coating surface", these coating films are left at room temperature as they are, or forcedly dried at about 50–about 100° C. for some 1–30 minutes to keep these coating films in an uncured condition, or cured these coating films through heating at about 120–about 160° C. for about 10–about 40 minutes, and then a topcoat paint (C) or clear paint (D) is coated on these coating surfaces.

Topocoat Paint (C)

In the process of the present invention it is possible to coat the clear paint (D) to be described later directly on the uncured or cured coating surface of the composition (B). Optionally, however, a topcoat paint (C) may be coated before the coating with the clear paint (D).

As the topcoat paint (C) an organic solvent type thermocurable topcoat paint, which contains base resin, crosslinking agent and organic solvent, comprises, as necessary, solid color pigment, metallic pigment, ultraviolet absorbent etc. and can form a colored or colorless transparent coating film which has such a transparency that the metallic impression of the coating film of the composition (B) could be visually recognized through the cured coating film to be formed, is generally preferable.

Base resin, crosslinking agent and organic solvent used for the topcoat paint (C) are not particularly restricted and similar products to those in the known topcoat paints can be used. For example, as a base resin there can be mentioned acrylic resin, polyester resin, alkyd resin etc. containing crosslinking functional group such as hydroxyl group and as a crosslinking agent there can be mentioned melamine resin, urea resin, (blocked) polyisocyanate compound etc. which can react with such a functional group. As a melamine resin a partially or fully etherified melamine resin with a monohydric alcohol with carbon number 1–8 and having 1–5 triazine nuclei is preferable. A melamine resin containing imino group can be also used. The ratio of base resin and crosslinking agent is usually suitable in the range of 50–90% by weight, particularly 65–80% by weight of the former and 50–10% by weight, particularly 45–20% by weight of the latter based upon the total solid content of both components.

As organic solvent there can be used, for example, usual solvent for paint use of hydrocarbon type, ester type, ether type, alcohol type, ketone type etc.

As pigment for solid color suitably compoundable to the topcoat paint (C) there can be mentioned, for example, inorganic pigments such as titanium oxide, zinc oxide, carbon black, cadmium red, molybdenum red, chrome yellow, chromium oxide, Prussian blue, cobalt blue etc.; organic pigments such as azo pigment, phthalocyanine pigment, quinacridone pigment, isoindoline pigment, threne type pigment, perylene pigment etc. Metallic pigment includes, for example, flake-like aluminium, mica, mica whose surface is covered with metal oxide, mica-like iron oxide etc.

It is preferable to further compound the above-mentioned resin composition containing phosphoric acid group (P-1) or resin composition containing phosphoric acid group (P-2) to the topcoat paint (C) so that the interlayer adhesivity with the neighboring coating films can be improved. Its compounding amount is generally suitable in the range of 1–30 parts by weight, particularly 3–25 parts by weight, more particularly 5–20 parts by weight per 100 parts by weight of the total solid content of base resin and crosslinking agent.

It is preferable to adjust the solid content concentration of the topcoat paint (C) at the time of coating to about 20–about 80% by weight and to coat the paint on the uncured coating surface or cured coating surface of the composition (B) by means of electrostatic process or spray process etc. to the film thickness based upon a cured coating film of about 5–about 100 $\mu$m, preferably about 20–about 80 $\mu$m.

In the process of the present invention, after the topcoat paint (C) is coated, the coating film is left at room temperature as it is, or forcedly dried it at about 50–about 100° C. for some 1–30 minutes to keep it in an uncured condition, or cured it through heating at about 120–about 160° C. for about 10–about 40 minutes, then a clear paint (D) is coated.

Clear Paint (D)

In the present invention as a clear paint (D) there can be preferably used an organic solvent type thermocurable clear paint which generally contains base resin, crosslinking agent and organic solvent, comprises, as necessary, solid color pigment, metallic pigment, interference pigment, ultraviolet absorbent etc., and can form colorless transparent or colored transparent coating film with such a transparency that the metallic impression of the underlayer coating film of the composition (B) could be visually recognized through the clear coating film to be formed.

As a base resin usable for clear paint (D) there can be mentioned, for example, resins containing crosslinking functional group such as hydroxyl group, carboxyl group, silanol group, epoxy group etc. such as acrylic resin, polyester resin, alkyd resin, fluororesin, urethane resin, siliconcontaining resin etc. and particularly acrylic resin containing crosslinking functional group is preferable. As a crosslinking agent there can be mentioned melamine resin, urea resin, (blocked) polyisocyanate compound, epoxy compound or resin, carboxyl group-containing compound or resin, acid anhydride, alkoxysilane group-containing compound or resin etc. which can react with the above-mentioned functional groups. As the above-mentioned melamine resin a partially or fully etherified melamine resin with a monohydric alcohol with carbon number 1–8 and having 1–5 triazine nuclei is preferable. A melamine resin containing imino group can be also used. The compounding ratio of base resin and crosslinking agent is suitably in the range of 50–90% by weight, particularly 65–80% by weight of the former and 50–10% by weight, particularly 45–20% by weight of the latter based upon the total solid content of both components.

It is preferable to use, among these, a combination of an acrylic resin (base resin) containing crosslinking functional group such as carboxyl group, silanol group, epoxy group etc. and a cross-linking agent selected from epoxy compound or resin, carboxyl group-containing compound or resin, acid anhydride etc. which can form a coating film which is excellent in acid resistance, scratch resistance etc.

As organic solvent there can be used, for example, usual solvent for paint use of hydrocarbon type, ester type, ether type, alcohol type, ketone type etc.

In the process of the present invention, the clear paint (D), whose solid content concentration at the time of coating is adjusted generally to about 30–about 80% by weight, is coated on the uncured coating surface or cured coating surface of the composition (B) or the topcoat paint (C) by means of electrostatic process or spray process etc. to the film thickness based upon a cured coating film of about 5–about 100 μm, preferably about 20–about 80 μm and then the coating film of the clear paint (D) is cured through heating at about 100–about 180° C. for about 10–about 40 minutes. At that time, in case the coating films of basecoat paint (A), composition (B) and/or topcoat paint (C) are uncured, these coating films are cured at the same time of the curing of the coating film of the clear paint (D).

According to the above-mentioned process of the present invention it is preferable to form metallic multilayer coating films from the basecoat paint (A), composition (B), topcoat paint (C) and clear paint (D) according to the following coating and baking processes (1) Basecoat paint (A) coating-uncured-composition (B) coating-uncured-clear paint (D) coating-curing through heating.

(2) Basecoat paint (A) coating-uncured-composition (B) coating-uncured-topcoat paint (C) coating-uncured-clear paint (D) coating-curing through heating.

(3) Basecoat paint (A) coating-uncured-composition (B) coating-uncured-topcoat paint (C) coating-curing through heating—clear paint (D) coating-curing through heating.

(4) Basecoat paint (A) coating-uncured-composition (B) coating-curing through heating-topcoat paint (C) coating-uncured-clear paint (D) coating-curing through heating.

According to the process of the present invention the following effects can be obtained.

(1) As a coating film with the composition (B) comprising mainly non-leafing aluminium flake and organic solvent is formed between the coating film of thermocurable basecoat paint (A) and the coating film of topcoat paint (C) or clear paint (D), said aluminium flake orientates uniformly and to the parallel direction on the coating surface of basecoat paint (A) and a metallic coating film, which is white, excellent in metallic luster impression with a high flip-flop effect compared with a metallic coating film by using a conventional non-leafing aluminium flake pigment, can be formed.

(2) By containing resin composition containing phosphoric acid group in the basecoat paint (A) the interlayer adhesivity between the coating film of basecoat paint (A) and the coating film of composition (B) can be improved without lowering the effect that the coating film is white, excellent in metallic luster impression with strong flip-flop property.

(3) By containing resin composition containing phosphoric acid group in the composition (B) the interlayer adhesivity between the coating film of composition (B) and the coating films of basecoat paint (A) and topcoat paint (C) or clear paint (D) can be improved without lowering the effect that the coating film is white, excellent in metallic luster impression with a high flip-flop effect.

(4) By coating with clear paint (D) the finishing appearance of the final multilayer coating films such as gloss, smoothness etc. is further improved.

(5) The multilayer coating films formed according to the process of the present invention have good heat-insulating property and therefore the temperature inside of a car is not easily affected by the condition of outside atmosphere.

EXAMPLES

Then the present invention is described more specifically by examples and comparative examples. "Parts" and "%" are by weight, unless specified.

1. Sample

1) Substrate

After the thermocurable epoxy resin type cationic electrodeposition paint ("Elecron 9600" made by Kansai Paint Co., Ltd., trade name) is coated by electrodeposition to the cured film thickness of about 20 μm on a dull finished steel plate of 0.8 mm thick, which has been chemically treated with zinc phosphate, and cured through heating at 170° C. for 30 minutes, the intermediate paint for car coating (thermocurable polyester resin/melamine resin type organic solvent type "TP-37 Primer Surfacer" made by Kansai Paint Co., Ltd., trade name) is coated by air spray to the cured film thickness of about 25 μm and cured through heating at 140° C. for 30 minutes to make a substrate for test.

2) Basecoat Paint (A)

(A-1)

75 Parts of acrylic resin containing hydroxyl group (*1), 25 parts of butyl etherified melamine resin (*2) are mixed with and dispersed in "Swasol 1000" (*3) and adjusted to a viscosity of 13 seconds/Ford cup #4/20° C.

(*1) Acrylic resin containing hydroxyl group:

A polymer obtained from methyl methacrylate 38%, ethyl acrylate 17%, n-butyl acrylate 17%, hydroxyethyl methacrylate 7%, lauryl methacrylate 20% and acrylic acid 1%. Number-average molecular weight 50000, Hydroxyl value 54 mgKOH/g.

(*2) Butyl etherified melamine resin:

U-Van 28–60 (made by Mitsui-Toatsu Chemicals, Inc., trade name)

(*3) "Swasol 1000"

Made by Cosmo Oil Co., Ltd., trade name, petroleum-derived aromatic hydrocarbon type solvent.

(A-2)

75 Parts of acrylic resin containing hydroxyl group (*1), 25 parts of butyl etherified melamine resin (*2) and 20 parts by weight of resin containing phosphoric acid group (P-1) (*4) are mixed with and dispersed in "Swasol 1000" and adjusted to a viscosity of 13 seconds/Ford cup #4/20° C.

(*4) Resin containing phosphoric acid group (P-1):

Resin containing phosphoric acid group, hydroxyl group and alkoxymethylamide group obtained by polymerizing 5 parts by weight of acid phosphoxyethyl methacrylate, 15 parts by weight of 2-hydroxyethyl methacrylate, 15 parts by weight of N-butoxymethylacrylamide, 20 parts by weight of styrene, 15 parts by weight of n-butyl methacrylate and 30 parts by weight of 2-ethylhexyl methacrylate in a mixed solvent of equal weight of xylene and butanol (acid value 21 mgKOH/g, hydroxyl value 72 mgKOH/g, number-average molecular weight 11000) is mixed with organic solvent (xylene).

(A-3)

75 Parts of acrylic resin containing hydroxyl group (*1), 25 parts of butyl etherified melamine resin (*2) and 20 parts of resin composition containing phosphoric acid group (P-1) (*5) are mixed with and dispersed in "Swasol 1000" and adjusted to a viscosity of 13 seconds/Ford cup #4/20° C.

(*5) Resin composition containing phosphoric acid group (P-1):

A copolymer of monomers consisting of 30 parts of acid phosphoxyethyl methacrylate, 15 parts of 2-hydroxyethyl acrylate, 20 parts of methyl methacrylate, 5 parts of n-butyl methacrylate and 30 parts of 2-ethylhexyl methacrylate. Number-average molecular weight 13000, hydroxyl value 72 mgKOH/g, acid value 126 mgKOH/g.

(A-4) (For Comparative Example)

75 Parts of acrylic resin containing hydroxyl group (*1), 25 parts of butyl etherified melamine resin (*2) and 10 parts of non-leafing aluminium flake (*6) are mixed with and dispersed in "Swasol 1000" (*3) and adjusted to a viscosity of 13 seconds/Ford cup #4/20° C.

(A-5) (For Comparative Example)

75 Parts of acrylic resin containing hydroxyl group (*1), 25 parts of butyl etherified melamine resin (*2) and 30 parts of non-leafing aluminium flake (*6) are mixed with and dispersed in "Swasol 1000" (*3) and adjusted to a viscosity of 13 seconds/Ford cup #4/20° C.

(A-6) (For Comparative Example)

75 Parts of acrylic resin containing hydroxyl group (*1), 25 parts of butyl etherified melamine resin (*2) and 15 parts of non-leafing aluminium flake (*6) are mixed with and dispersed in "Swasol 1000" (*3) and adjusted to a viscosity of 13 seconds/Ford cup #4/20° C.

(*6) Non-leafing aluminium flake:

"Alpaste 7680NS" (made by Toyo Aluminium K.K., trade name, length in longitudinal direction 13 μm, thickness 0.1–2 μm).

3) Composition (B)

(B-1)

A mixture consisting of 5 parts of non-leafing aluminium flake (*6) and 95 parts of "Swasol 1000" (*3).

(B-2)

A mixture consisting of 5 parts of non-leafing aluminium flake (*7) and 95 parts of "Swasol 1000" (*3).

(*7) Non-leafing aluminium flake:

"Alpaste 7620NS" (made by Toyo Aluminium K.K., trade name, length in longitudinal direction 18 μm, thickness 0.1–2 μm).

(B-3)

A mixture consisting of 5 parts of non-leafing aluminium flake (*6), 95 parts of "Swasol 1000" (*3) and 2.5 parts of resin containing phosphoric acid group (P-1) (*4).

(B-4)

A mixture consisting of 5 parts of non-leafing aluminium flake (*6), 95 parts of "Swasol 1000" (*3), 3 parts of acrylic resin (hydroxyl value 100, number-average molecular weight 15000) and 1 part of butyl etherified melamine resin (*2).

(B-5)

A mixture consisting of 5 parts of non-leafing aluminium flake (*6), 95 parts of "Swasol 1000" (*3) and, as antisettling agents, 2.5 parts of "Disparlon 6900–20X" (*8) and 1.0 part of "Disparlon 4200–20" (*9).

(*8) "Disparlon 6900–20X"

Solid content 20%, made by Kusumoto Chemicals Ltd., trade name, fatty acid amide wax.

(*9) "Disparlon 4200–20"

Solid content 20%, made by Kusumoto Chemicals Ltd., trade name, polyethylene oxide.

(B-6)

A mixture consisting of 5 parts of non-leafing aluminium flake (*6), 95 parts of "Swasol 1000" (*3), 2.5 parts of resin containing phosphoric acid group (P-1) (*4), 3 parts of acrylic resin (hydroxyl value 100, number-average molecular weight 15000), 1 part of butyl etherified melamine resin (*2), 2.5 parts of "Disparlon 6900–20X" (*8) and 1.0 part of "Disparlon 4200–20" (*9).

(B-7)

A mixture consisting of 5 parts of non-leafing aluminium flake (*6), 95 parts of "Swasol 1000" (*3) and 2.5 parts of resin containing phosphoric acid group (P-1) (*4).

(B-8)

A mixture consisting of 5 parts of non-leafing aluminium flake (*6), 95 parts of "Swasol 1000" (*3), 2.5 parts of resin containing phosphoric acid group (P-1) (*4), 2.5 parts of "Disparlon 6900–20X" (*8), 1.0 part of "Disparlon 4200–20" (*9), 3 parts of acrylic resin containing hydroxyl group (*1) and 1 part of butyl etherified melamine resin (*2).

4) Topcoat Paint (C)

(C-1)

75 Parts of acrylic resin containing hydroxyl group (*1) and 25 parts of butyl etherified melamine resin (*2) are mixed with and dispersed in "Swasol 1000" (*3) and adjusted to a viscosity of 13 seconds/Ford cup #4/20° C.

(C-2)

75 Parts of acrylic resin containing hydroxyl group (*1), 25 parts of butyl etherified melamine resin (*2) and 20 parts of resin composition containing phosphoric acid group (P-1) (*4) are mixed with and dispersed in "Swasol 1000" (*3) and adjusted to a viscosity of 13 seconds/Ford cup #4/20° C.

(C-3)

75 Parts of polyester resin containing hydroxyl group (*10), 25 parts of butyl etherified melamine resin (*2) are mixed with and dispersed in "Swasol 1000" (*3) and adjusted to a viscosity of 13 seconds/Ford cup #4/20° C.

(*10) Polyester resin containing hydroxyl group:

A polyester resin prepared by using phthalic anhydride, hexahydrophthalic anhydride, ethylene glycol and trimethylolpropoane. Number-average molecular weight 3500, hydroxyl value 82 mgKOH/g, acid value 8 mgKOH/g.

(C-4)

75 Parts of polyester resin containing hydroxyl group (*10), 25 parts of butyl etherified melamine resin (*2) and 20 parts of resin composition containing phosphoric acid group (P-1) (*4) are mixed with and dispersed in "Swasol 1000" (*3) and adjusted to a viscosity of 13 seconds/Ford cup #4/20° C.

5) Clear Paint (D)

(D-1)

50 Parts of acrylic resin containing carboxyl group (*11), 50 parts of acrylic resin containing epoxy group (*12), 1 part of Tinuvin 900 (made by Ciba-Geigy, trade name, ultraviolet absorbent), 2 parts of equivalent compounded substance of tetrabutylammonium bromide and monobutyl phosphoric acid, 0.1 part of "BYK300" (made by BYK Chemie, trade name, leveling agent) are mixed with and dispersed in "Swasol 1000" (*3) and adjusted to a viscosity of 20 seconds/Ford cup #4/20° C.

(*11) Acrylic resin containing carboxyl group:

A polymer obtained from methanol half ester of maleic anhydride 20%, 4-hydroxy-n-butyl acrylate 20%, n-butyl acrylate 40% and styrene 20%. Number-average molecular weight 3500, acid value 86 mgKOH/g, hydroxyl value 78 mgKOH/g.

(*12) Acrylic resin containing epoxy group:

A polymer obtained from glycidyl methacrylate 30%, 4-hydroxy-n-butyl acrylate 20%, n-butyl acrylate 30% and styrene 20%. Number-average molecular weight 3000, epoxy group content 2.12 mmol/g, hydroxyl value 78 mg-KOH/g.

2. Examples and Comparative Examples

Examples 1–7 and Comparative Examples 1–3

On the cured intermediate coating surface of the above-mentioned substrate base paint (A) is coated and, without curing it, composition (B) is coated, and, without curing it, clear paint (D) is further coated, and then these multilayer coating films are simultaneously cured through heating at 140° C. for 30 minutes.

Procedures of these coatings as well as results of performance test of the obtained multilayer coating films are shown in Table 1.

TABLE 1

| | Examples | | | | | | | Comparative Examples | | |
|---|---|---|---|---|---|---|---|---|---|---|
| | 1 | 2 | 3 | 4 | 5 | 6 | 7 | 1 | 2 | 3 |
| Base paint | | | | | | | | | | |
| Name | A-1 | A-2 | A-2 | A-1 | A-2 | A-2 | A-1 | A-4 | A-5 | A-6 |
| Film thickness | 13–17 μm as cured coating film | | | | | | | | | |
| Drying | Standing at room temperature for 3 minutes | | | | | | | | | |
| Composition | | | | | | | | | | |
| Name | B-1 | B-1 | B-2 | B-3 | B-4 | B-5 | B-6 | — | — | — |
| Film thickness | 1 μm as cured coating film | | 2 μm as cured coating film | | | | | — | — | — |
| Drying | Standing at room temperature for 3 minutes | | | | | | | — | — | — |
| Clear paint | | | | | | | | | | |
| Name | D-1 | | | | | | | | | |
| Film thickness | 45–50 μm as cured coating film | | | | | | | | | |
| Curing | 140 for 30 minutes | | | | | | | | | |
| Test results | | | | | | | | | | |
| IV value | 400< | 400< | 400< | 380 | 350 | 380 | 350 | 220 | 280 | 230 |
| SV value | 110 | 110 | 80 | 110 | 120 | 110 | 120 | 150 | 130 | 130 |
| Visual appearance evaluation | ○ | ○ | ○ | ○ | ○ | ○ | ○ | X | ○ | X |
| Adhesivity | | | | | | | | | | |
| Initial stage | ○ | ○ | ○ | ○ | ○ | ○ | ○ | ○ | ○ | ○ |
| Dipped in warm water 1 | ○ | ○ | ○ | ○ | ○ | ○ | ○ | ○ | X | ○ |
| Dipped in warm water 2 | ○ | ○ | ○ | ○ | ○ | ○ | ○ | ○ | X | ○ |
| Storability | Δ | Δ | Δ | Δ | ○ | ○ | ○ | — | — | — |

Methods for performance tests of multilayer coating films are as follows.

IV Value

Y Value at light receiving angle 15 is measured by using a laser type metallic feeling measurement apparatus "Alcope LMR-200" made by Kansai Paint Co., Ltd. This represents the brightness of the coating film and shows the brightness feeling of the highlight part of a metallic coating film. The larger this value is, the better the brightness feeling is.

SV Value

This is measured by using "Alcope LMR-200". It represents the light scattering property of the coating film and the smaller this value is, the lower the light scattering property is. It means that the aluminium flake orientates horizontally and the scattered light is little.

Visual Appearance Evaluation (Designability)

Flip-flop property (F/F) is observed. ○ shows strong F/F, Δ shows weak F/F and × shows very weak F/F.

Here F/F means the change of whiteness by aluminium flake, when the coating surface is seen from the front and from the diagonal direction. "Strong" means that it looks white from the front and blackish from the diagonal direction and the difference is big. Very weak means that the whiteness from the front is inferior and the difference from the color seen from the diagonal direction is small.

Adhesivity

100 Squares of 1×1 mm size are made by drawing cut lines by a cutter reaching to the ground surface. Adhesive cellophane tape is adhered on the surface and the coating surface is observed, after the tape is radically peeled off. ○ shows that no peeling-off of square coating film is observed at all, Δ shows that peeling-off of 1 or 2 squares of coating film is observed, and × shows that peeling-off of more than 10 squares of coating film is observed.

"Initial stage" is a result of a test made with a coating film which has been made by coating with basecoat paint (A), composition (B) and clear paint (C) and simultaneously curing the multilayer coating films through heating at 140° C. for 30 minutes and leaving as they are in the atmosphere at room temperature for 2 hours. "Dipped in warm water 1" is a result of a test at room temperature with a coating film dipped in warm water of 80° C. for 5 hours and "dipped in warm water 2" is a result of a test at room temperature with a coating film dipped in warm water of 80° C. for 24 hours.

Storability

The condition of the composition (B) is visually observed after it is tightly closed and stored at 20° C. for 10 days. ○ shows that aluminium flake does not deposit or can be easily dispersed again, even if it deposited and Δ shows that aluminium flake deposits and it is relatively difficult to disperse it again.

Examples 8–18 and Comparative Examples 4–7

On the cured intermediate coating surface of the above-mentioned substrate base paint (A), composition (B), topcoat paint (C) and clear paint (D) are coated to form metallic multilayer coating films. Coating procedures using these paints are shown in Table 2 and the results of performance test of the obtained metallic multi-layer coating films are shown in Table 3.

TABLE 2

| | Examples | | | | | | | | | | | Comparative Examples | | | |
|---|---|---|---|---|---|---|---|---|---|---|---|---|---|---|---|
| | 8 | 9 | 10 | 11 | 12 | 13 | 14 | 15 | 16 | 17 | 18 | 4 | 5 | 6 | 7 |
| Base paint (A) | | | | | | | | | | | | | | | |
| Name | A-3 | A-3 | A-1 | A-1 | A-1 | A-1 | A-1 | A-1 | A-1 | A-1 | A-3 | A-4 | A-5 | A-6 | A-6 |
| Film thickness | 10–20 μm | | | | | | | | | | | | | | |
| Drying | Room temperature | | | | | | | | | | | | | | |
| Composition (B) | | | | | | | | | | | | | | | |
| Name | B-1 | B-5 | B-7 | B-8 | B-5 | B-5 | B-8 | B-8 | B-8 | B-8 | B-8 | — | — | — | — |
| Film thickness | 1–2 μm | | | | | | | | | | | | | | |
| Drying/Heating | Room temperature | | | | | | | Heating | | | Room temperature | — | — | — | — |
| Topcoat paint (C) | | | | | | | | | | | | | | | |
| Name | C-1 | C-1 | C-1 | C-1 | C-2 | C-4 | C-2 | C-4 | C-1 | C-3 | C-2 | C-1 | C-1 | C-1 | |
| Film thickness | 10–20 μm | | | | | | | | | | | | | | — |
| Drying/Heating | Room temperature | | | | | | Heating | | | | Room temperature | | | | — |
| Clear paint (D) | | | | | | | | | | | | | | | |
| Name | D-1 | D-1 | D-1 | D-1 | D-1 | D-1 | D-1 | D-1 | D-1 | D-1 | D-1 | D-1 | D-1 | D-1 | D-1 |
| Film thickness | 30–45 μm | | | | | | | | | | | | | | |
| Drying/Heating | Heating | | | | | | | | | | | | | | |

TABLE 3

| | Examples | | | | | | | | | | | Comparative Examples | | | |
|---|---|---|---|---|---|---|---|---|---|---|---|---|---|---|---|
| | 8 | 9 | 10 | 11 | 12 | 13 | 14 | 15 | 16 | 17 | 18 | 4 | 5 | 6 | 7 |
| Finishing | | | | | | | | | | | | | | | |
| IV value | 400< | 350 | 380 | 360 | 350 | 350 | 360 | 360 | 390 | 390 | 370 | 230 | 225 | 230 | 220 |
| SV value | 110 | 120 | 115 | 115 | 120 | 120 | 115 | 115 | 110 | 110 | 120 | 145 | 155 | 150 | 150 |
| Visual observation | ○ | ○ | ○ | ○ | ○ | ○ | ○ | ○ | ○ | ○ | ○ | X | X | X | X |
| Adhesivity | | | | | | | | | | | | | | | |
| Initial stage | ○ | ○ | ○ | ○ | ○ | ○ | ○ | ○ | ○ | ○ | ○ | ○ | ○ | ○ | ○ |
| Warm water 1 | ○ | ○ | ○ | ○ | ○ | ○ | ○ | ○ | ○ | ○ | ○ | ○ | ○ | ○ | ○ |
| Warm water 2 | ○ | ○ | ○ | ○ | ○ | ○ | ○ | ○ | ○ | ○ | ○ | ○ | ○ | ○ | ○ |

Methods for performance tests of coating films are the same as in case of table 1.

What is claimed is:

1. A process for forming a metallic multilayer coating film, comprising coating on an uncured coating surface of a paint formed on a substrate with a composition (B), which contains non-leafing aluminum flake and organic solvent and less than 300 parts by weight as solid content of a resin component per 100 parts by weight of the non-leafing aluminum flake, then optionally coating with a topcoat paint (C), and subsequently coating with a clear paint (D).

2. The process set forth in claim 1 wherein the paint forming the uncured coating surface is an organic solvent thermocurable basecoat paint (A) containing base resin, crosslinking agent and organic solvent.

3. The process set forth in claim 2 wherein the basecoat paint (A) is a paint which further contains a resin composition containing phosphoric acid group.

4. The process set forth in claim 3 wherein the resin composition containing phosphoric acid group is either (P-1) a polymer containing phosphoric acid group and hydroxyl group which contains an unsaturated monomer unit containing phosphoric acid group and an unsaturated monomer unit containing hydroxyl group as constitutional components, or (P-2) a non-aqueous dispersion containing phosphoric acid group consisting of dispersed polymer particles, which are polymer particles containing an unsaturated monomer unit containing phosphoric acid group as a constitutional component, in a solution of a dispersion stabilizer in an organic solvent.

5. The process set forth in claim 3 wherein the basecoat paint (A) contains less than 70 parts by weight as solid content of the resin composition containing phosphoric acid group per 100 parts by weight of the total solid content of base resin and crosslinking agent.

6. The process set forth in claim 1 wherein the composition (B) contains, based upon the total amount of the non-leafing aluminum flake and organic solvent, 1–50% by weight of the former and 99–50% by weight of the latter.

7. The process set forth in claim 1 wherein the composition (B) further contains 0.1–200 parts by weight as solid content of a resin composition containing phosphoric acid group selected from either (P-1) a polymer containing phosphoric acid group and hydroxyl group which contains an unsaturated monomer unit containing phosphoric acid group and an unsaturated monomer unit containing hydroxyl group as constitutional components, or (P-2) a non-aqueous dispersion containing phosphoric acid group consisting of dispersed polymer particles, which are polymer particles containing an unsaturated monomer unit containing phosphoric acid group as a constitutional component, per 100 parts by weight of the non-leafing aluminum flake.

8. The process set forth in claim 1 wherein the composition (B) further contains less than 50 parts by weight as solid content of an antisettling agent for pigment per 100 parts by weight of the non-leafing aluminum flake.

9. The process set forth in claim 1 wherein the composition (B) is coated to a film thickness of 0.5–5 sum.

10. The process set forth in claim 1 wherein the topcoat paint (C) is an organic solvent thermocurable topcoat paint forming a colored or colorless transparent coating film.

11. The process set forth in claim 10 wherein the topcoat paint (C) contains a resin composition containing phosphoric acid group selected from either (P-1) a polymer containing phosphoric acid group and hydroxyl group which contains an unsaturated monomer unit containing phosphoric acid group and an unsaturated monomer unit containing hydroxyl group as constitutional components, or (P-2) a non-aqueous dispersion containing phosphoric acid group consisting of dispersed polymer particles, which are polymer particles containing an unsaturated monomer unit containing phosphoric acid group as a constitutional component.

12. The process set forth in claim 1 wherein the clear paint (D) is a thermocurable paint forming a coating film having acid resistance and scratch resistance properties.

13. The process set forth in claim 2 wherein the composition (B) is coated on the uncured coating surface of the basecoat paint (A) formed on a substrate, and then the clear paint (D) is coated on said coating surface, and the coating films of the basecoat paint (A), composition (B) and clear paint (D) are simultaneously cured through heating.

14. The process set forth in claim 2 wherein the organic solvent thermocurable basecoat paint (A), composition (B), organic solvent thermocurable topcoat paint (C) and thermocurable clear paint (D) are coated one after another on a substrate and then the 4-layer coating films are simultaneously cured through heating.

15. The process set forth in claim 2 wherein the organic solvent thermocurable basecoat paint (A), composition (B) and organic solvent thermocurable topcoat paint (C) are coated one after another on a substrate and the 3-layer coating films are simultaneously cured through heating, and then the thermocurable clear paint (D) is coated and the coating film is cured through heating.

16. The process set forth in claim 2 wherein the organic solvent thermocurable basecoat paint (A) and composition (B) containing non-leafing aluminum flake and organic solvent are coated one after another on a substrate and the 2-layer coating films are simultaneously cured through heating, and then the organic solvent thermocurable topcoat paint (C) and thermocurable clear paint (D) are coated on said coating surface and the 2-layer coating films are simultaneously cured through heating.

17. An article on which a metallic multilayer coating film is formed according to the process set forth in claim 1.

* * * * *